US007083531B2

(12) United States Patent
Aguinaldo et al.

(10) Patent No.: US 7,083,531 B2
(45) **Date of Patent: *Aug. 1, 2006**

(54) IRON-TYPE GOLF CLUB

(75) Inventors: Homer E. Aguinaldo, San Diego, CA (US); Robert R. Lang, Escondido, CA (US); Andrew Oldknow, Laguna Niguel, CA (US)

(73) Assignee: Callaway Golf Company, Carlsbad, CA (US)

( * ) Notice: Subject to any disclaimer, the term of this patent is extended or adjusted under 35 U.S.C. 154(b) by 34 days.

This patent is subject to a terminal disclaimer.

(21) Appl. No.: 10/710,717

(22) Filed: Jul. 29, 2004

(65) Prior Publication Data

US 2006/0025237 A1 Feb. 2, 2006

(51) Int. Cl.
*A63B 53/04* (2006.01)

(52) U.S. Cl. ..... 473/350; 473/345

(58) Field of Classification Search ..... 473/324–350
See application file for complete search history.

(56) References Cited

U.S. PATENT DOCUMENTS

| | | | |
|---|---|---|---|
| 3,655,188 | A | 4/1972 | Solheim |
| 3,897,065 | A | 7/1975 | Solheim |
| 3,955,820 | A | 5/1976 | Cochran et al. |
| 3,961,796 | A | 6/1976 | Thompson |
| 3,995,857 | A | 12/1976 | Cochran et al. |
| 3,995,858 | A | 12/1976 | Cochran et al. |
| 3,995,865 | A | 12/1976 | Cochran et al. |
| 4,162,794 | A | 7/1979 | Thompson |
| 4,180,269 | A | 12/1979 | Thompson |
| 4,313,607 | A | 2/1982 | Thompson |
| 4,319,752 | A | 3/1982 | Thompson |
| 4,512,577 | A | 4/1985 | Solheim |
| 4,521,022 | A | 6/1985 | Schmidt |
| 4,621,813 | A | 11/1986 | Solheim |
| 4,995,609 | A | 2/1991 | Parente et al. |
| 5,067,711 | A | 11/1991 | Parente et al. |
| 5,193,805 | A | 3/1993 | Solheim |
| 5,222,734 | A | 6/1993 | Parente et al. |
| 5,263,718 | A | 11/1993 | Salheim |
| 5,275,399 | A | 1/1994 | Schmidt et al. |

(Continued)

FOREIGN PATENT DOCUMENTS

JP 10005378 A * 1/1998

(Continued)

OTHER PUBLICATIONS

Jeff Jackson, Modern Guide to Golf Clubmaking. Ohio: Dynacraft Golf Products, Inc., copyright 1994, pp. 11-16.*

*Primary Examiner*—Eugene Kim
*Assistant Examiner*—Alvin A. Hunter, Jr.
(74) *Attorney, Agent, or Firm*—Michael A. Catania; Elaine H. Lo

(57) ABSTRACT

An iron-type golf club head (20) includes a body (22) having a front wall (28) with a ball-striking surface (40). The body (22) further includes a rear surface (54) that has external rear cavity (56) formed therein. The rear surface (54) includes an upper portion (58) and a lower portion (60). The upper portion (60) is separated from the lower portion (59) by the external rear cavity (56) and at least one groove (64, 66). The lower portion (60) of the rear surface (54) has a notch (62) formed therein, which communicates with the external rear cavity (56). The golf club head (20) preferably has high moments of inertia Izz and Ixx.

19 Claims, 3 Drawing Sheets

U.S. PATENT DOCUMENTS 5,282,625 A 2/1994 Schmidt et al.
5,292,122 A 3/1994 Solheim
5,297,803 A 3/1994 Solheim
5,301,946 A 4/1994 Schmidt et al.
5,320,347 A 6/1994 Parente et al.
5,330,187 A 7/1994 Schmidt et al.
5,375,840 A 12/1994 Hirsch et al.
5,423,534 A 6/1995 Solheim
5,429,353 A 7/1995 Hoeflich
5,429,355 A 7/1995 Schmidt et al.
5,437,456 A 8/1995 Schmidt et al.
5,472,203 A 12/1995 Schmidt et al.
D368,947 S * 4/1996 Blough et al. ..... D21/748
5,540,436 A * 7/1996 Boone ..... 473/350
5,549,296 A 8/1996 Gilbert
5,588,922 A 12/1996 Schmidt et al.
5,588,923 A 12/1996 Schmidt et al.
5,591,092 A 1/1997 Gilbert
5,595,552 A 1/1997 Wright et al.
5,607,363 A 3/1997 Chou
5,626,530 A 5/1997 Schmidt et al.
5,643,099 A 7/1997 Solheim
5,695,411 A 12/1997 Wright et al.
5,749,795 A 5/1998 Schmidt et al.
5,776,010 A 7/1998 Helmstetter et al.
5,800,281 A 9/1998 Gilbert
5,813,919 A 9/1998 Best et al.
5,971,868 A 10/1999 Kosmatka
6,045,455 A 4/2000 Kosmatka et al.
6,045,456 A 4/2000 Best et al.
6,093,116 A 7/2000 Hettinger et al.
6,186,903 B1 2/2001 Beebe et al.
6,206,790 B1 3/2001 Kubica et al.
6,210,290 B1 4/2001 Erickson et al.
6,260,250 B1 7/2001 Hall et al.
6,290,607 B1 9/2001 Gilbert
6,406,382 B1 6/2002 Deshmukh et al.
D464,693 S * 10/2002 Rollinson et al. ..... D21/748
6,471,601 B1 11/2002 McCabe et al.
6,530,846 B1 3/2003 Mase
6,533,679 B1 3/2003 McCabe et al.
6,554,722 B1 4/2003 Erickson et al.
D474,822 S * 5/2003 Cleveland et al. ..... D21/747
6,592,469 B1 7/2003 Gilbert
6,623,374 B1 9/2003 Helmstetter et al.
6,645,085 B1 11/2003 McCabe et al.
6,579,784 B1 1/2004 Mase
6,688,989 B1 2/2004 Best
6,695,714 B1 2/2004 Bliss et al.
6,743,114 B1 6/2004 Best
6,743,117 B1 6/2004 Gilbert
6,769,998 B1 8/2004 Clausen et al.
6,857,973 B1 * 2/2005 Wieland et al. ..... 473/342
6,887,164 B1 * 5/2005 Dewanjee et al. ..... 473/342

FOREIGN PATENT DOCUMENTS

JP 2002191729 A * 7/2002
JP 2003190339 A * 7/2003
JP 2003199850 A * 7/2003

* cited by examiner

IRON-TYPE GOLF CLUB

CROSS REFERENCE TO RELATED APPLICATIONS

Not Applicable

FEDERAL RESEARCH STATEMENT

Not Applicable

BACKGROUND OF INVENTION

1. Field of the Invention

The present invention relates to an iron-type golf club. More specifically, the present invention relates to an iron-type golf club head with improved perimeter weighting.

2. Description of the Related Art

The location and distribution of weight within a golf club is an important factor in the performance of the golf club. In particular, weight placement at the bottom of the golf club head provides a low center of gravity to help propel a golf ball into the air during impact, and weight concentrated at the heel and toe of the golf club head provides a resistance to twisting, or high moment of inertia, during impact. Both the low center of gravity and high moment of inertia are important performance variables that affect playability and feel of the golf club. Alternative designs have resulted in many innovations for varying the weight location and distribution in a golf club head.

One approach to varying the weight distribution and location in a golf club head combines materials of different densities in the club head. U.S. Pat. No. 5,776,010 to Helmstetter et al. discloses a high density block or contoured shape attached, via mechanical means, such as friction fit, fasteners or screws, to a reciprocal recess in the golf club head. Although this approach provides the desired performance enhancements, the high density block and reciprocal recess must be machined to precise tolerances, which involves high production costs.

Another approach is to add mass at certain areas of the club head. U.S. Pat. Nos. 5,390,924 and 5,395,113 to Antonious disclose a perimeter-weighted, cavity-back iron with integrally formed weight members located on an upper sole surface of a perimeter weight. U.S. Pat. No. 5,026,056 to McNally et al. discloses another perimeter-weighted, cavity-back iron with heel and toe weight pads positioned within the back cavity. U.S. Pat. No. 5,377,985 to Ohnishi discloses an iron-type golf club head with four weights projecting rearward from the face wall at the upper and lower toe side portions and upper and lower heel side portions of the club head.

SUMMARY OF INVENTION

The present invention provides an iron-type golf club head which has a low center of gravity, a high moment of inertia, reduced vibrations, and a solid feel and appearance. The iron-type golf club head includes a body having a front wall, which provides a ball-striking surface, and a rear surface. The rear surface has an external rear cavity formed therein. The rear surface further includes an upper portion and a lower portion. The lower portion has a notch formed therein, which communicates with the external rear cavity. The upper and lower portions of the rear surface are separated by the external rear cavity and at least one groove. The at least one groove may include a first groove extending from the external rear cavity toward a heel end of the club head and a second groove extending from the external rear cavity toward a toe end of the club head. In addition, the lower portion of the rear surface may extend further rearward of the upper portion.

Having briefly described the present invention, the above and further features and advantages thereof will be recognized by those skilled in the pertinent art from the following detailed description of the invention when taken in conjunction with the accompanying drawings.

DETAILED DESCRIPTION

Figure 1:
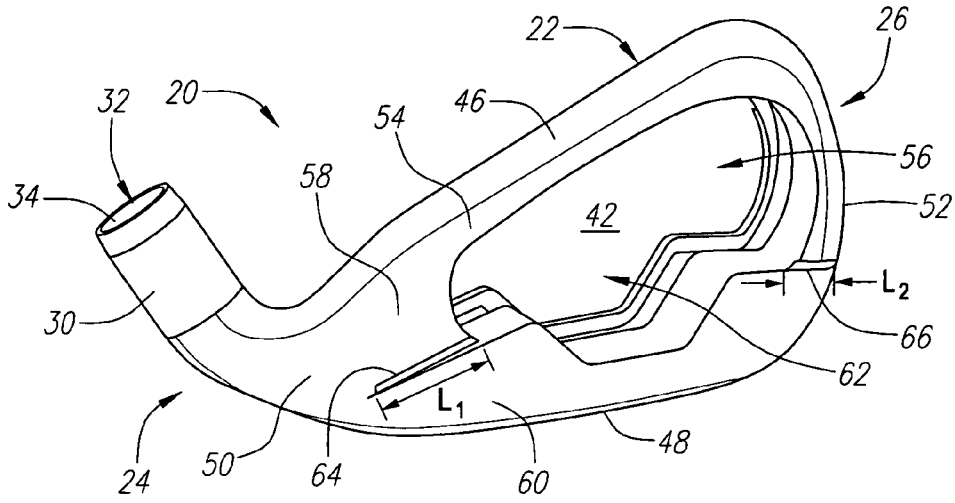
FIG. 1 is a rear perspective view of an iron-type golf club head according to an embodiment of the present invention.
Figure 2:
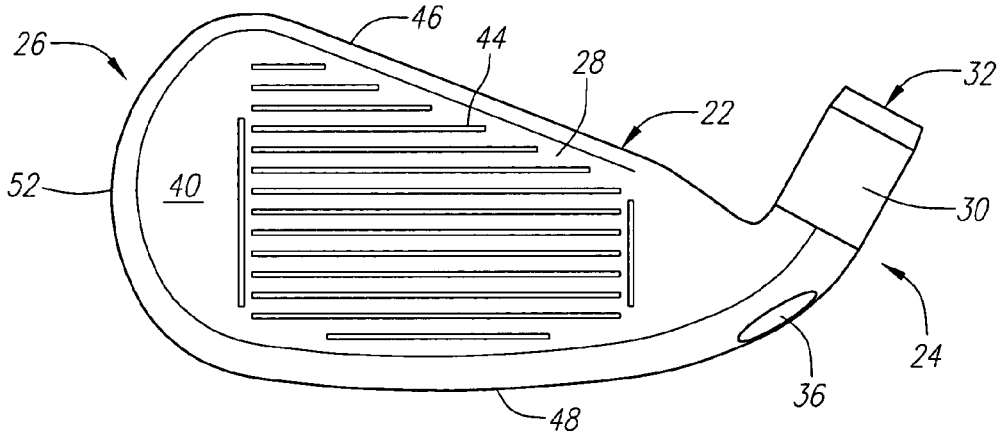
FIG. 2 is a front plan view of the iron club head of FIG. 1.
Figure 3:
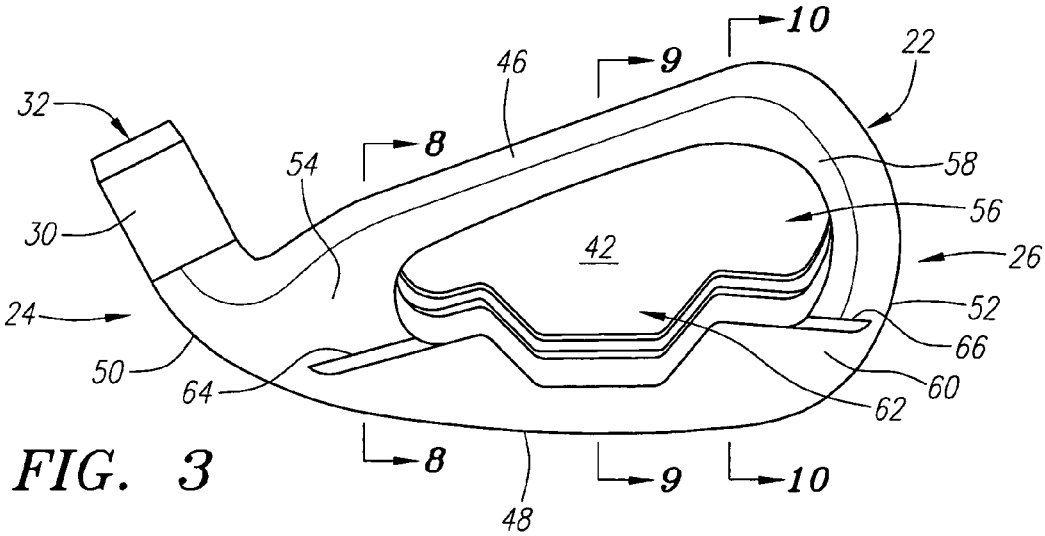
FIG. 3 is a rear plan view of the iron club head of FIG. 1.
Figure 4:
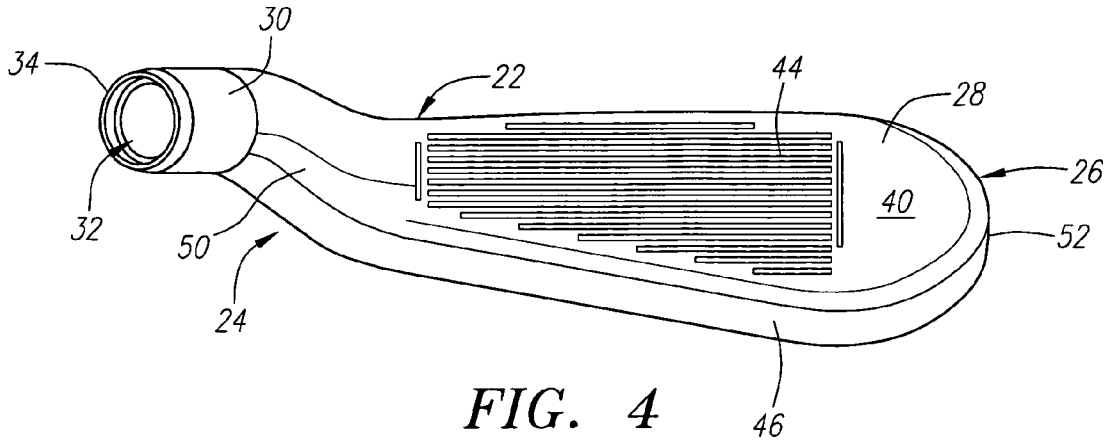
FIG. 4 is a top plan view of the iron club head of FIG. 1.
Figure 5:
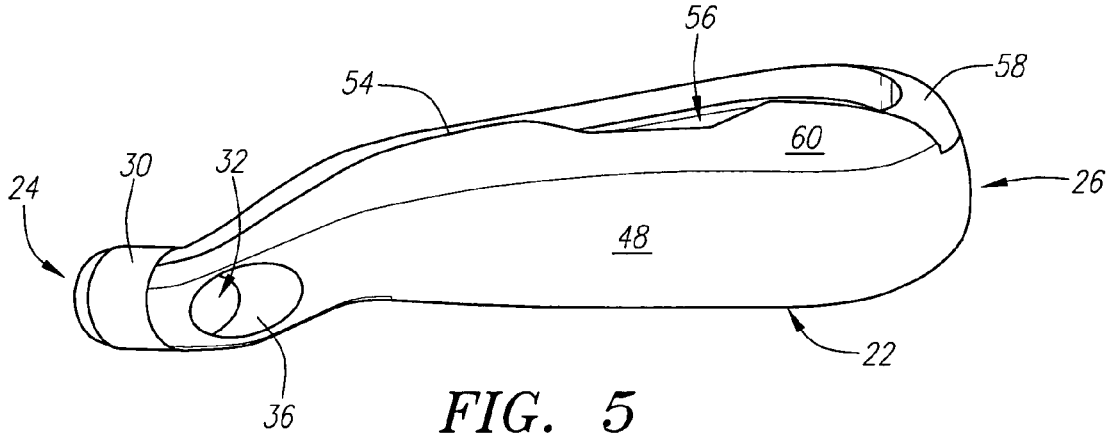
FIG. 5 is a bottom plan view of the iron club head of FIG. 1.
Figure 6:
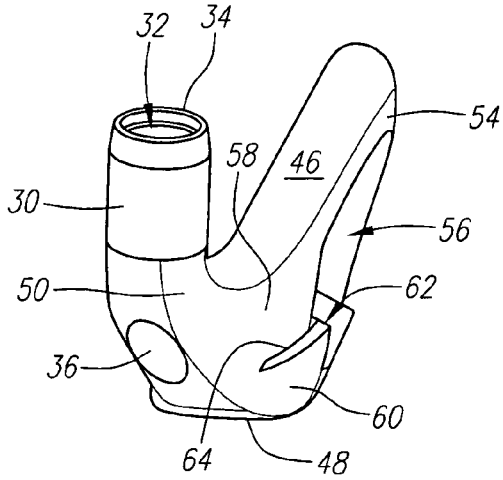
FIG. 6 is a heel side view of the iron club head of FIG. 1.
Figure 7:
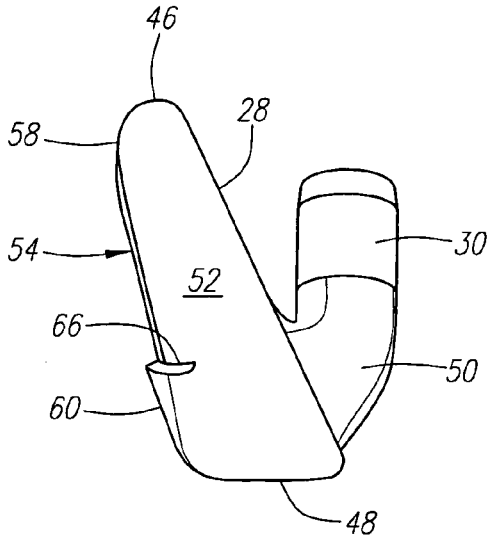
FIG. 7 is a toe side view of the iron club head of FIG. 1.

As shown in FIGS. 1–10, an iron-type golf club head in accordance with the present invention is generally designated 20. The club head 20 is a cavity-back iron and includes a body 22 having a heel end 24 and a toe end 26. The body 22 has a front wall 28 for contacting a golf ball and a hosel 30 for receiving a shaft, not shown. The hosel 30 has a bore 32 with an ingress opening 34 and optionally an egress opening 36. In a preferred embodiment the golf club head 20 is composed of a stainless steel, however, those of ordinary skill in the art will appreciate that the golf club head 20 may also be composed of other materials, such as carbon steel, titanium, titanium alloy, zirconium or zirconium alloy.

The front wall 28 of golf club head 20 has a ball-striking surface 40 and a back surface 42. The ball-striking surface 40 has a plurality of scorelines 44 formed therein. In a preferred embodiment the top of the hosel 30 is lower than the toe end of the front wall 28, thereby lowering the center of gravity of the club head 20.

The golf club head 20 also has a top wall 46, a bottom wall 48, a heel wall 50, a toe wall 52 and a rear surface 54. The top wall 46 extends rearward from the top end of the front wall 28, in a direction opposite the ball-striking surface 40, to the rear surface 54 of the body 22. The bottom wall 48 extends rearward from the bottom end of the front wall 28 to the rear surface 54. The heel wall 50 extends rearward from the heel end 24 of the front wall 28 to the rear surface 54, and the toe wall 52 extends rearward from the toe end 26 of the front wall 28 to the rear surface 54. The rear surface 54, the top wall 46, the bottom wall 48, the heel wall 50 and the toe wall 52 define an external rear cavity 56 in the body 22 of the club head 20. The top wall 46, the bottom wall 48, the heel wall 50 and the toe wall 52 also provide the club head 20 with perimeter weighting to make the club head more forgiving and provide better performance for the typical golfer.

The rear surface 54 includes an upper portion 58 and a lower portion 60. A notch 62 is formed in the lower portion 60 of the rear surface 54. The notch 62 is in communication with the external rear cavity 56 to provide enhanced perimeter weighting by removing mass from a central, rear portion of the club head and thereby increasing perimeter weighting at the heel and toe ends of the club head 20.

The upper portion 58 of the rear surface 54 is separated from the lower portion 60 by the external rear cavity 56, a first groove 64 and a second groove 66. The first groove 64 extends from the external rear cavity 56 toward the heel end 24 of the body 22, while the second groove 66 extends from the external rear cavity 56 toward the toe end 26 of the body 22. Each groove preferably has a width W of approximately 0.040 inch. The length $L_1$ of the first groove 64 is preferably in the range of 0.25 inch to 0.75 inch. The length $L_2$ of the second groove 66 is preferably in the range of 0.20 inch to 0.50 inch.

Figure 8:
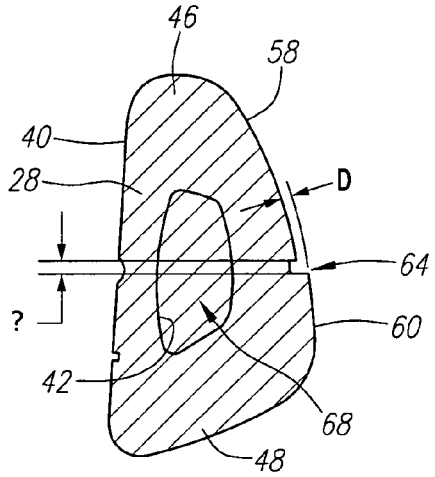
FIG. 8 is a cross-sectional view taken generally along line 8—8 of FIG. 3.
Figure 9:
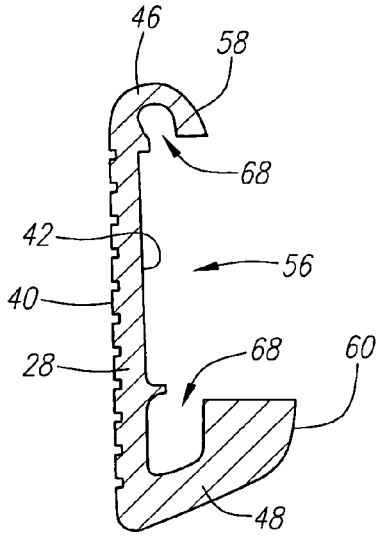
FIG. 9 is a cross-sectional view taken generally along line 9—9 of FIG. 3.
Figure 10:
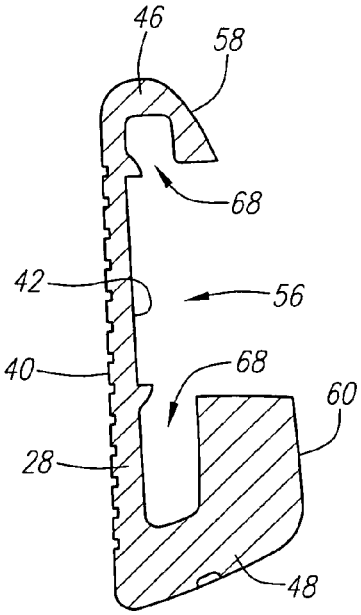
FIG. 10 is a cross-sectional view taken generally along line 10—10 of FIG. 3.

As best illustrated in FIG. 8, the lower portion 60 of the rear surface 54 extends further rearward than the upper portion 58 by a distance D. In the preferred embodiment the distance D is at least 0.035 inch. Having the lower portion 60 of the rear surface 54 extend rearward of the upper portion 58 provides the club head 20 with an increase in mass at the lower rear portion, which moves the club head's center of gravity further back from the ball-striking surface 40.

The golf club head 20 preferably includes an undercut recess 68 in communication with the external rear cavity 56. The undercut recess 68 preferably circumscribes the external rear cavity 56. Alternatively, the undercut recess 68 may extend along only a portion of the external rear cavity 56. A medallion, not shown, is preferably disposed in the external rear cavity 56 of the body 22.

Figure 11:
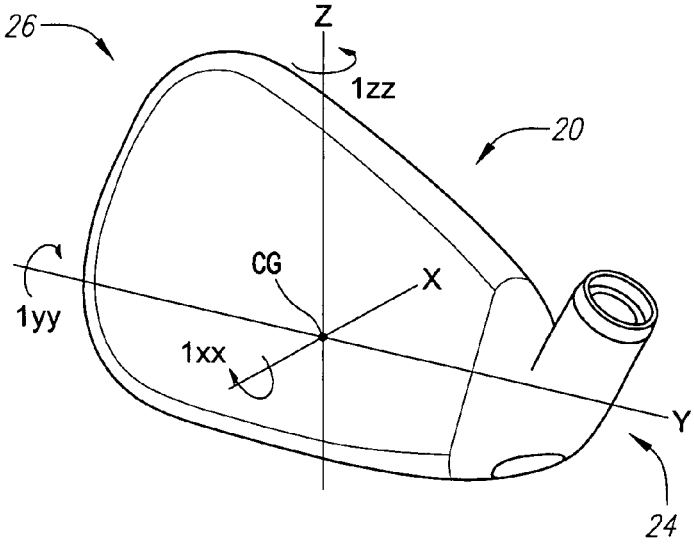
FIG. 11 is a front perspective view of a golf club head illustrating the moments of inertia through the center of gravity.

FIG. 11 illustrates the axes of inertia through the center of gravity of the golf club head. The axes of inertia are designated X, Y and Z. The X-axis extends from rear of the golf club head 20 through the center of gravity, CG, and to the front wall. The Y-axis extends from the heel end 24 of the golf club head 20 through the center of gravity, CG, and to the toe end 26 of the golf club head 20. The Z-axis extends from the bottom wall through the center of gravity, CG, and to the top wall.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moments of inertia of the golf club head 20 are preferably measured using a test frame ($X^T$, $Y^T$, $Z^T$), and then transformed to a head frame ($X^H$, $Y^H$, $Z^H$). The center of gravity of the golf club head 20 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, the shaft is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z-axis for the golf club head 20 preferably ranges from 2100 g-cm$^2$ to 2700 g-cm$^2$. The moment of inertia, Iyy, about the Y-axis for the golf club head 20 preferably ranges from 400 g-cm$^2$ to 800 g-cm$^2$. The moment of inertia, Ixx, about the X-axis for the golf club head 20 preferably ranges from 2200 g-cm$^2$ to 2800 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. An iron-type golf club head comprising:

a body including a front wall having a ball-striking surface, a rear surface having an external rear cavity formed therein, a toe end and a heel end, the front wall being integrally formed with the body, the rear surface including an upper portion and a lower portion, the upper portion being separated from the lower portion by the external rear cavity and at least one groove; the lower portion of the rear surface having a notch formed therein, the notch communicating with the external rear cavity, wherein the at least one groove extends from the external rear cavity proximate an open end of the notch toward one of the heel end and the toe end.

2. The iron-type golf club head according to claim 1, wherein the at least one groove extends from the external rear cavity toward the heel end of the club head.

3. The iron-type golf club head according to claim 2, wherein the at least one groove that extends from the external rear cavity toward the heel end also extends downward toward a bottom wall of the club head.

4. The iron-type golf club head according to claim 1, wherein at least one groove includes a first groove extending from the external rear cavity toward the heel end of the club head, and a second groove extending from the external rear cavity toward the toe end of the club head.

5. The iron-type golf club head according to claim 4, wherein the first groove is not collinear with the second groove.

6. The iron-type golf club head according to claim 1, wherein the at least one groove has a width of approximately 0.040 inch.

7. The iron-type golf club head according to claim 1, wherein the lower portion of the rear surface extends at least approximately 0.035 inch rearward of the upper portion of the rear surface.

8. The iron-type golf club head according to claim 1, wherein the body includes an undercut recess along at least a portion of the external rear cavity.

9. The iron-type golf club head according to claim 1, wherein the body is composed of a material selected from the group consisting of steel, titanium, titanium alloy, zirconium and zirconium alloy.

10. The iron golf club head according to claim 1, wherein the club head has a moment of inertia Ixx through the center of gravity of at least 2200 g-cm$^2$and a moment of inertia Izz through the center of gravity of at least 2100 g-cm$^2$.

11. An iron-type golf club head comprising:

a body composed of a material selected from the group including stainless steel, titanium and titanium alloy, the body including a front wall having a ball-striking surface, a rear surface having an external rear cavity formed therein, a toe end and a heel end, the front wall being integrally formed with the body, the rear surface including an upper portion and a lower portion, the lower portion having a notch formed therein, the notch communicating with the external rear cavity, wherein the upper portion of the rear surface is separated from the lower portion by the external rear cavity, a first groove and a second groove, the first groove extending from the external rear cavity toward the heel end, and the second groove extending from the external rear cavity toward the toe end, and wherein the first groove is not collinear with the second groove.

12. The iron-type golf club head according to claim 11, wherein each of the first and second grooves has a width of approximately 0.040 inch.

13. The iron-type golf club head according to claim 11, wherein the lower portion of the rear surface extends at least approximately 0.035 inch rearward of the upper portion of the rear surface.

14. The iron-type golf club head according to claim 11, wherein the body includes an undercut recess along at least a portion of the external rear cavity.

15. The iron-type golf club head according to claim 11, wherein the first groove also extends downward toward a bottom wall of the club head.

16. An iron-type golf club head comprising:

a body including a front wall having a ball-striking surface, a rear surface having an external rear cavity formed therein, a toe end and a heel end, the front wall being integrally formed with the body, the rear surface including an upper portion and a lower portion, the lower portion extending further rearward than the upper portion and having a notch formed therein, the notch communicating with the external rear cavity, wherein the upper portion of the rear surface is separated from the lower portion by the external rear cavity, a first groove and a second groove, the first groove extending from the external rear cavity toward the heel end, and the second groove extending from the external rear cavity toward the toe end, and wherein the first groove is not collinear with the second groove.

17. The iron-type golf club head according to claim 16, wherein each of the first and second grooves has a width of approximately 0.040 inch.

18. The iron-type golf club head according to claim 16, wherein the lower portion of the rear surface extends at least approximately 0.035 inch rearward of the upper portion of the rear surface.

19. The iron-type golf club head according to claim 16, wherein the first groove also extends downward toward a bottom wall of the club head.

* * * * *